United States Patent [19]

Buchko

[11] Patent Number: 4,944,442

[45] Date of Patent: Jul. 31, 1990

[54] WEB RETENTION AND ADVANCEMENT MECHANISM

[75] Inventor: Raymond G. Buchko, Appleton, Wis.

[73] Assignee: Curwood, Inc., Oshkosh, Wis.

[21] Appl. No.: 254,432

[22] Filed: Oct. 6, 1988

[51] Int. Cl.[5] ..... B65H 20/00; B65H 5/02

[52] U.S. Cl. ..... 226/171; 271/277; 271/272

[58] Field of Search ..... 226/171; 53/559, 560; 271/277, 272, 315, 382

[56] References Cited

U.S. PATENT DOCUMENTS

| | | | |
|---|---|---|---|
| 2,410,611 | 5/1945 | Pratt et al. | 271/275 |
| 2,697,901 | 12/1954 | Hosack | 53/559 |
| 4,659,073 | 4/1987 | Leonard | 271/254 X |

OTHER PUBLICATIONS

Article "From Resin to Sealed", Aug. 1962.

*Primary Examiner*—Daniel P. Stodola
*Assistant Examiner*—Paul T. Bowen
*Attorney, Agent, or Firm*—Lee, Mann, Smith, McWilliams & Sweeney

[57] ABSTRACT

A web retention and advancement mechanism for a rotating drum utilizes a pair of spaced belts operating in grooves formed in the drum peripheral surface to retain the web to the drum for an arcuate portion of its rotation. Pulleys spaced from the grooves guide the belts in a path that extends about a portion of the drum and about the pulleys. The pulleys are spaced axially a distance greater than the inner edges of the grooves to cause the belts to travel a convergent path toward the drum to grip edges of the web in the grooves and hold the web to the drum while the belts are disposed in the drum grooves. A divergent path from the drum permits the belts to release the web.

13 Claims, 4 Drawing Sheets

WEB RETENTION AND ADVANCEMENT MECHANISM

BACKGROUND OF THE INVENTION

The present invention is directed to a web retention and advancement mechanism for releasably securing and retaining a web material to a rotating die turret of a packaging machine. More particularly, it relates to a belt and groove configuration which coact to receive and hold the web to the rotating turret for a period of its rotation.

Numerous arrangements for temporarily securing a process material to a rotating drum are known. Examples are found in U.S. Pat. Nos.: 639,409; 2,760,626; 4,373,712; 1,825,440; 4,355,749; 4,659,073; and 2,410,611. None of these prior arrangements disclose the features of the present invention.

SUMMARY OF THE INVENTION

The mechanism of the present invention includes a belt and groove configuration which coact to releasably retain a web of material upon a rotating drum. It includes a pair of axially spaced grooves on the drum, a pair of pulleys spaced from the drum and a pair of endless belts tensioned between the drum grooves and pulleys. The pulleys are spaced apart axially a distance greater than the inner edges of the grooves such that the belts travel from the pulleys toward the drum in a closing action. This closing action grips the edges of the web within the grooves. The belts remain in the drum grooves for an arc of the drum rotation to advance the web. The belts exit the grooves and travel to the pulleys in an opening motion to release the web.

DETAILED DESCRIPTION OF THE DRAWINGS

DETAILED DESCRIPTION OF ILLUSTRATED EMBODIMENT

Figure 1:
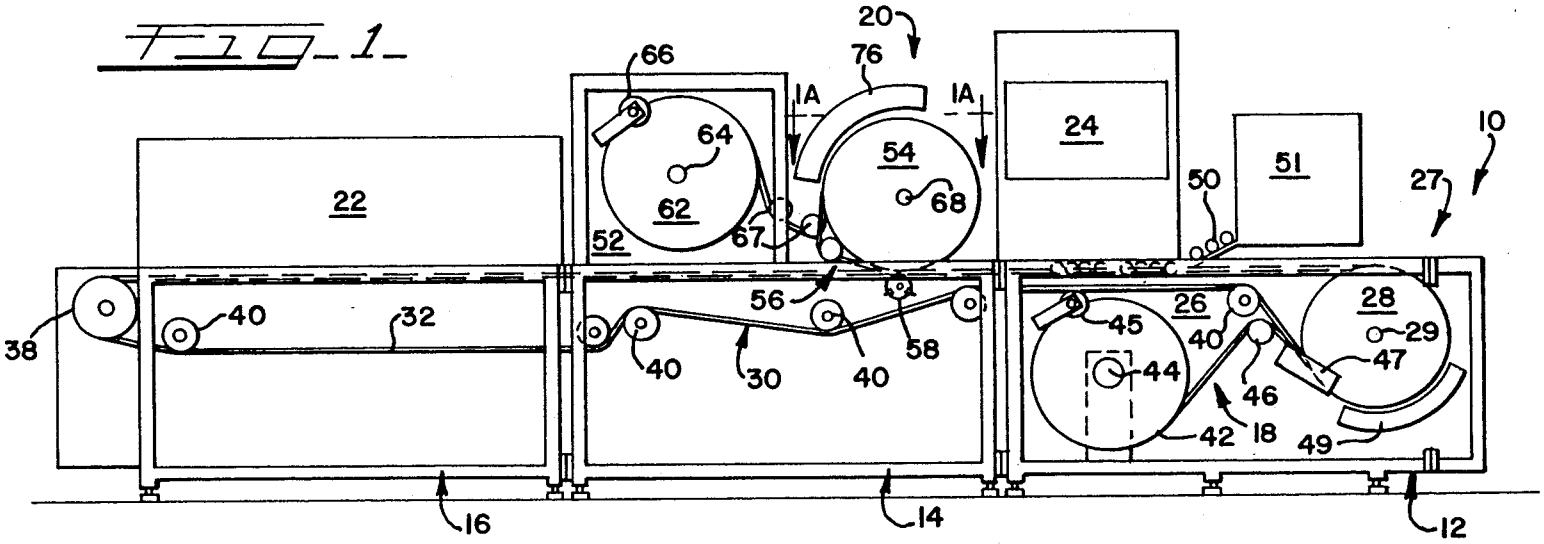
FIG. 1 is a plan view of a packaging machine incorporating the principles of the present invention.

Referring now to the drawings, there is depicted an embodiment of a web retention and advancement mechanism illustrative of the principles of the present invention. The inventive arrangement is illustrated in the environment of a packaging machine. The machine is disclosed and claimed in U.S. Pat. No. 4,897,985 entitled "Continuous Motion Package Forming Machine" filed in the names of inventors Raymond G. Buchko and John A. Halgren and assigned to a common assignee.

The disclosure therein is hereby incorporated by reference into this application.

It must be appreciated, however, that the web retention arrangement of the present invention is not limited to the embodiment or use shown and has wide application for temporary retention and advancement of a web upon a working surface.

The package formed by the packaging machine 10 is a sealed and evacuated packet which contains a quantity of product. It is formed of two separate plastic laminate films, each formed to partially surround the product in overlying relation to define the complete package when joined together. It should be understood that the particular package and product are purely for illustrative purposes. The packaging machine is adaptable to package any product for which plastic film packaging is desirable. The number of product units per package and the shape of depressions in one or both of the films for receiving the product is optional, dependent upon the packaging objective. These various alternatives are all within the scope of the invention.

Figure 1A:
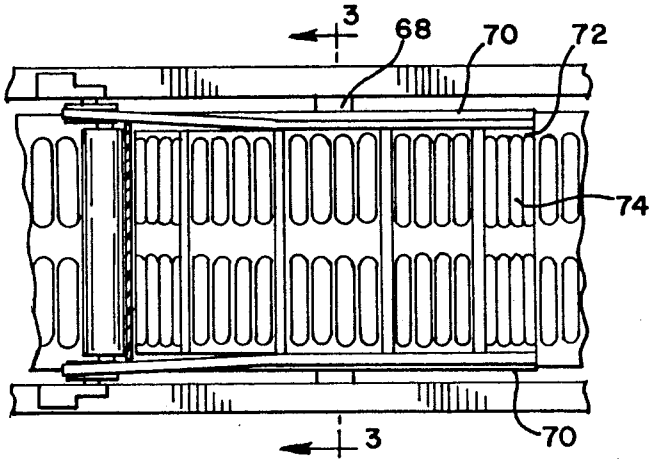
FIG. 1A is a partial top view of the packaging machine of FIG. 1 .

As best seen in FIGS. 1 and 1A, the packaging machine 10 includes separate, connected frame sections 12, 14, and 16. This framework supports a lower web forming and carrier arrangement, generally 18, an upper web forming and supply section, generally 20, a package closing mechanism, generally 22, and a control station 24. Control station 24 houses electronic processors which operate the separate machine elements in synchronization to produce the finished packages.

The machine 10 is categorized as a continuous motion, top and bottom forming machine. Continuous motion means that the webs move at a constant speed through a processing zone, rather than indexing incrementally along a path. Two webs are used to form the package. A bottom web and a top web encase product delivered to the lower web. Further processing of the webs thereafter results in formation of individual hermetically sealed packages. The webs may be of any plastic film suitable for heat and vacuum forming and protection of product, such as foodstuffs. One or both of the films may be coated or laminated to provide particular sealing or opening capabilities.

Machine 10 advances a continuous lower web of plastic film at constant speed along a horizontal processing zone, generally 27, commencing at frame section 12, and terminating at the free end of section 16. Product is disposed upon the lower web at section 12. A continuous upper web is advanced and placed in overlying relation to the lower web at section 14 by upper web forming and supply section 20. Further processing steps are performed upon the joined webs by package closing mechanism 22 and completed packages exit the horizontal processing zone at the free end of section 16.

Lower web forming and carrier arrangement 18 comprises a lower web supply station 26, a rotatable lower web forming drum or turret 28 and a lower web conveyor system generally designated 30. The conveyor system, best seen in FIGS. 1 and 3, includes a pair of spaced apart continuous chains 32, provided with closely spaced web clamps 34. Chains 32 travel a continuous path shown in FIG. 1, about sprocket teeth formed on turret 28, along horizontal processing zone 27, across machine frame sections 12, 14 and 16, about drive sprockets 38, and back to turret 28.

Figure 3:
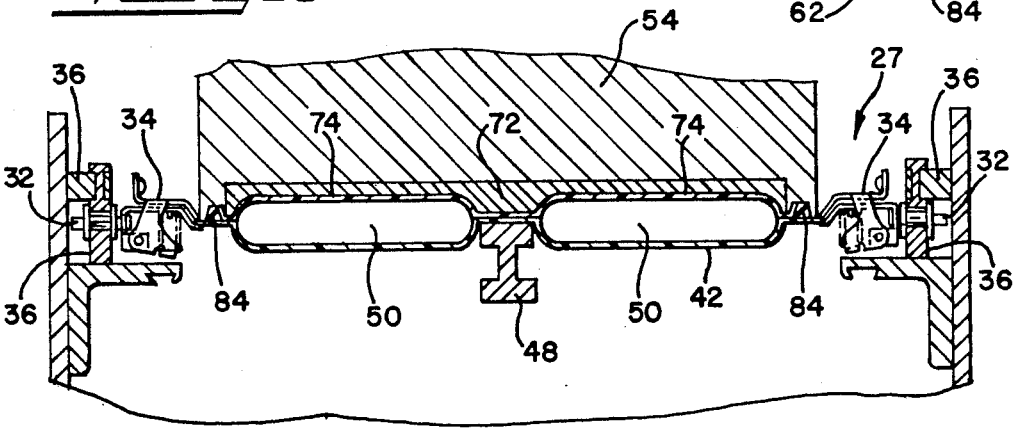
FIG. 3 is a sectional view of the packaging machine of FIG. 1 taken along the lines 3—3 of FIG. 1A.

As best seen in FIG. 3, chains 32 are guided along path 27 by chain guide and support rails 36 attached to the upper end of frames 14, 16 and 18. The rails 36 are spaced apart a distance greater than the width of the lower web and support and guide the chains. The rails also retain the chains from movement toward each other. The return path is defined by a plurality of idler sprockets 40 which provide appropriate tension in the chains. A motor, not shown, provides power to drive sprocket 38 to move the chains at a constant speed.

Clamps 34 may be of any suitable configuration to receive and carry a web from the supply station 26 along the horizontal processing zone 27 for purposes of the packaging operation. An example of one such clamp is found in application for U.S. Pat. No. 4,915,412 entitled "Clamping Arrangement For Gripping And Carrying Web Material" filed in the names of inventors Raymond G. Buchko and John A. Halgren, and assigned to a common assignee. The disclosure therein is hereby incorporated by reference into this application.

Lower web supply station 26 houses a roll of plastic laminate film or web 42, upon a shaft 44. A lower web guide 45 is biased into guiding contact with the roll and insures alignment of the web 42 as it is removed from the roll.

Web 42 passes over guide roll 46 and is fed into a web attachment mechanism generally designed 47, which opens clamps 34 to receive the opposing transverse edges of the webs. As the clamps pass from the mechanism 47, the clamps close and grip web 42 and carry it about turret 28 and along horizontal processing zone 27. As best seen in FIG. 3, the chains travel along within chain guide rails 36, and lower web 42 is centrally supported by a support rail 48 best seen in FIG. 3.

Lower web forming turret 28 rotates on shaft 29. It is driven by engagement of the chains 32 with the sprockets formed on the periphery of the turret. It has a generally cylindrical outer surface which includes a plurality of die sets that impart shaped depressions into the web 42 by a heat and vacuum process. The depressions have a depth of about one-half the thickness of the product and are shaped to receive hot dogs in groupings of four. The dies are arranged to form two such groupings in side-by-side relation across the axial width of the web 42.

The interior of the turret is connected to appropriate cooling and vacuum mechanisms to accomplish web shaping. A heating mechanism 49 is closely spaced from lower turret 28, which heats film on web 42 as it passes between the heater and the dies carried by turret 28. In the embodiment illustrated, the formed lower web advances from turret 28 along horizontal processing path 27 and product 50 is deposited into the formed shapes in the web by a product supply mechanism generally designated 51. The web continues to advance along the path 27 with the upper halves of the product exposed above the surface of the web 42.

Upper web forming and supply mechanism 20 forms and advances a continuous web of plastic film and deposits it upon the lower web in overlying relation to the product. Mechanism 20 is supported upon frame section 14 and includes upper web supply station 52, rotatable upper web forming turret 54, and web retention and advancement mechanism 56. A web joining bar mechanism 58 is disposed below the bottom of bottom web 42, which seals the webs together at spaced intervals for further processing as will be explained.

Upper web supply station 52 houses a roll of plastic laminate film 62 upon a shaft 64. An upper web guide 66 is biased into guiding contact with the roll and insures alignment of the web 42 as it is removed from the roll. Web 62 passes about one or more guide rolls 67 and is received and retained on turret 54 by the web retention and advancement mechanism 56 of the present invention.

Figure 2:
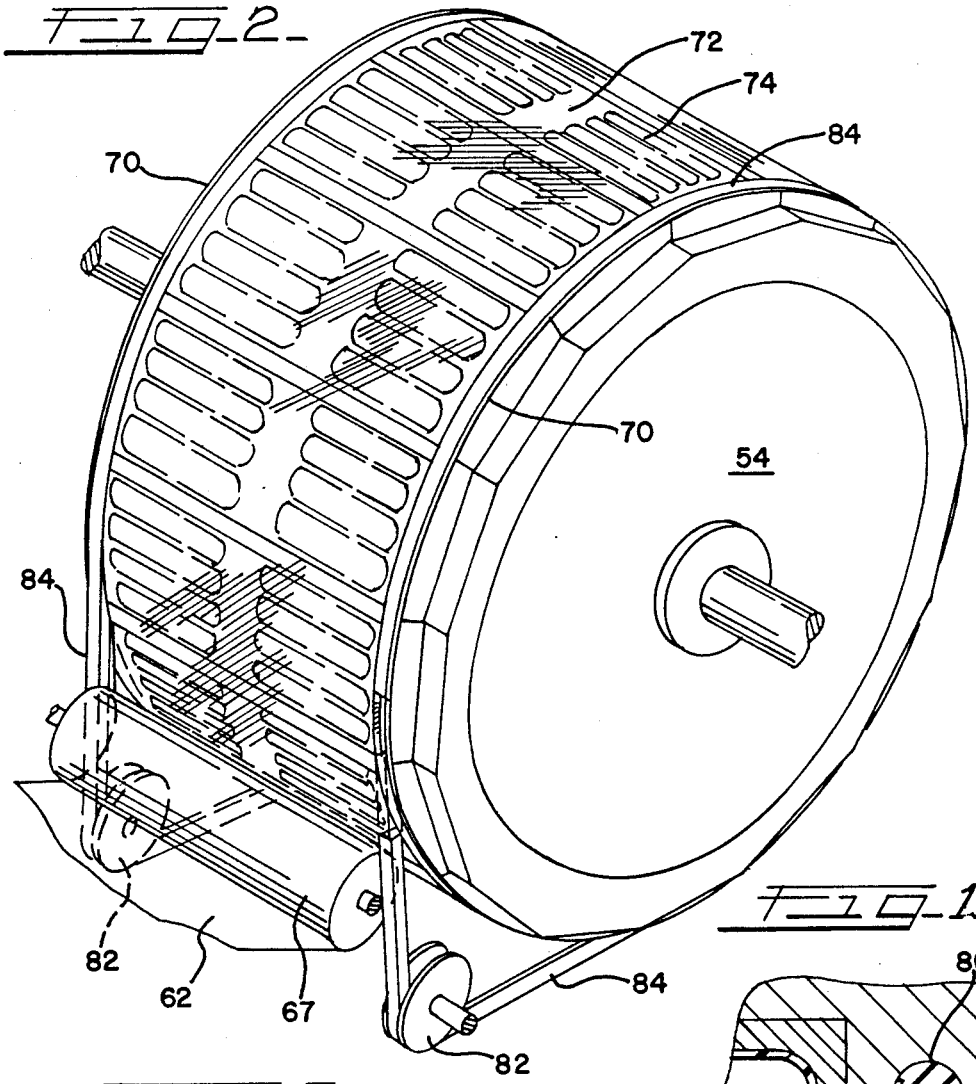
FIG. 2 is a fragmentary, perspective view illustrating the web retention and advancement mechanism of the present invention.

The upper web forming drum or turret 54, best seen in FIGS. 2 and 3 rotates on shaft 68 and is powered by the motor that powers chain drive sprocket 38. Turret 54 rotates in a clockwise direction as viewed in FIGS. 1 and 4 and delivers an upper or top web to the processing zone 27 in the same direction of movement on the advancing lower web 42. The drive is synchronized to rotate the upper turret 54 so as to supply the upper web 62 at a constant speed equal to the speed of advancement of lower web 42. Relative positions of each web are also synchronized such that the package portions formed on each web mate with each other as the webs are joined.

Upper web forming turret 54 imparts package shapes into the advancing web 62 by the vacuum forming process. The interior of turret 54 is connected to appropriate cooling and vacuum forming mechanisms to accomplish the web shaping. Turret 54 includes an outer generally cylindrical surface 70 upon which are disposed plural forming dies 72. A heater 76 is closely spaced from upper web forming turret 54. Web 62 passes between turret 54 and heater 76 and is heated by radiant heat during the forming process.

In the embodiment illustrated, the turret forming dies 72 includes depressions 74 defining pockets to receive hot dogs in groups of four. The depressions are of a depth of about one-half the thickness of the product to be packaged. The dies each include two sets of depressions 74 spaced side-by-side axially of the turret 54 to form two packages simultaneously. Fifteen such dies are positioned about turret 54. It should be noted that the configuration and disposition of forming dies 72 of upper turret 54 is typical of the die set configuration and disposition on the lower turret 28.

Figure 4:
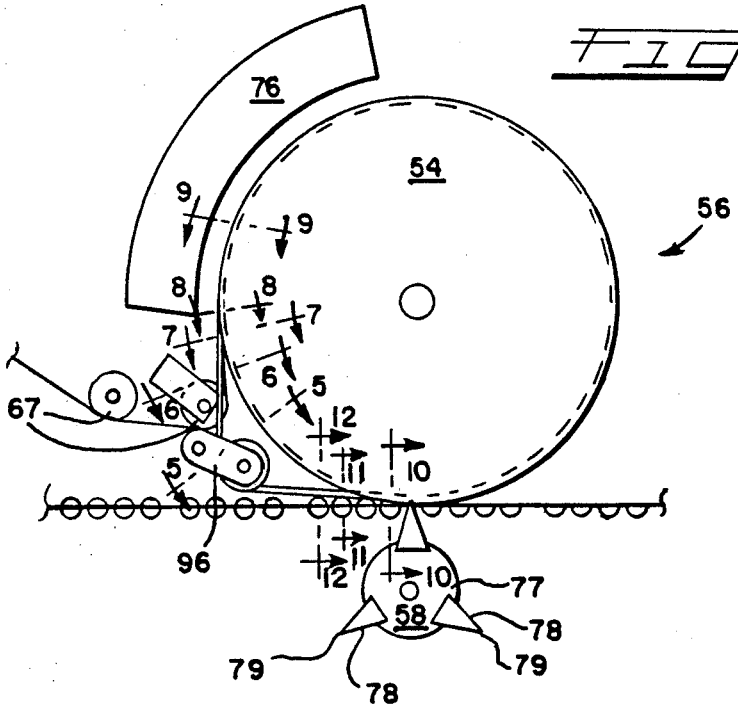
FIG. 4 is a fragmentary elevational view, on an enlarged scale, of a portion of the packaging machine of FIG. 1.

As best seen in FIGS. 3 and 4, turret 54 is disposed relative to horizontal processing zone 27 such that the lower web 42 is essentially tangent to the generally circumferential surface 70 of the turret. Upper web 62 is attached to lower web 42 at this tangent point.

Referring to FIG. 3 lower web 42, clamped between clamps 34 and supported mid-web by web support rail 48, advances along horizontal path 27 as a result of the continuous movement of chains 32 from lower turret 28 toward drive sprocket 38. Product 50 protrudes about one-half of its thickness from the depressions formed in the lower web by lower turret 28. As continuously advancing lower web 42 passes under upper die turret 54, upper web 62 is deposited upon lower web 42. As best seen in FIG. 3, the depressions formed in upper web 62 conform to the upper half of product 50 and are placed over the exposed product as it passes under the turret 54.

Web joining bar mechanism 58 is disposed below lower web 42. Its function is to join upper and lower webs 62 and 42 together after upper web 62 has been positioned in overlying relation to the lower web in encasing relation to product 50. Mechanism 58 includes a rotatable shaft 77 transverse to the advancing webs 42 and 62. A plurality of heater bars 78 extend the width of the webs. These bars include contact edges 79 which extend transversely below the lower web 42 and are heated to a predetermined temperature suitable to seal the web materials together.

A web joining bar mechanism is rotated in synchronization with the advancement of web 42. Contact edges 79 come in contact with the underside of lower web 42 between each group of package depressions 74. Bar contact with web 42 is made when the upper turret 54 is in a position such that the bar contacts the webs between depressions 74 and urges upper web 62 into contact with surface 70 of turret 54 to provide support for the webs as bar 78 heat seals the webs together.

In accordance with the present invention, web retention and advancement mechanism 56 retains upper web 62 upon surface 70 of upper turret 54 for an arc of its rotation. Rotation of the turret 54 advances the web 62 to the processing zone 27. Mechanism 56 includes a pair of parallel retention grooves 80 formed about cylindrical surface 70 of turret 54, a pair of belt guide pulleys 82 spaced from the turret and a pair of endless belts 84 each one of which travels in one groove 80 and about one pulley 82.

The grooves 80 are formed in the outer cylindrical surface 70 of turret 54 adjacent its transverse ends outward of die sets 72. As best seen in FIGS. 3-12, grooves 80 are of inverted trapezoidal cross section and are defined by inner annular walls 86 and outer annular walls 88 which converge radially inwardly from surface 70. The axial distance between inner edges 81 of grooves 80 is slightly less than the transverse width of web 62 for reasons which will become apparent.

Figure 5:
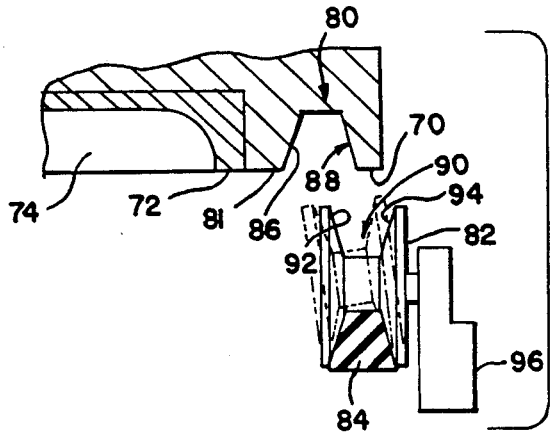
FIGS. 5–12 are fragmentary sectional views taken along the lines 5—5 to 12—12 of FIG. 4, illustrating various positional relationships.

As best seen in FIG. 5, pulleys 82 have grooves 90 of trapezoidal cross sections similar to the grooves 80 in turret 54. The grooves 90 are defined by inner and outer annular walls 92 and 94 which converge radially inwardly.

Pulleys 82 are rotatably supported on tension arms 96 biased away from turret 54 so as to maintain tension on belts 84. Arms 96 are positioned such that inner annular wall 92 of each pulley 82 is spaced axially outward of inner edge 81 of associated groove 80 and, therefore, axially outward of inner annular wall 86. The axes of rotation of pulleys 90 are generally parallel to the axis of rotation of turret 54. They may, however, be canted slightly such that the pulley grooves 90 converge in a direction toward the turret 54.

Endless belts 84 are of a trapezoidal cross-section to mate with the grooves 80 in turret 54 and grooves 90 of tensioning pulleys 82. Each belt includes an inner annular surface 98 and an outer annular surface 100 which converge radially inwardly. The belts, preferably made of urethane, are of a length sufficient to pass about the turret grooves and tensioning pulleys.

The pulleys 82 are positioned a distance from turret 54 sufficient to cause belts 84 to engage the grooves 80 for an arc less than the entire circumference of the generally cylindrical surface 70. In the embodiment illustrated belts 84 are disposed in grooves 80 for about 270 to 280 degrees of the turret circumference.

As best seen in FIGS. 1A and 4, the path of travel of the belts 84 from pulleys 82 to grooves 80 of turret cylindrical surface 70 is convergent toward the entrance to grooves 80. The path of the belts 84 from their exit from grooves 80 to contact with pulleys 90 is divergent toward the pulleys 90. Between the point of entrance into grooves 80 and exit from grooves 80, the belts are disposed within the grooves 80 with inner and outer annular surfaces 98 and 100 of the belt in contact with inner and outer walls 86 and 88 of grooves 80. During the arc of travel in which the belts 84 are fully disposed in grooves 80, the belts and groove walls travel at the same angular velocity. No relative movement between the belts and the grooves occurs.

The pulleys are further positioned such that the belts 84 travel a generally vertical path from pulleys 82 to grooves 80 and are tangent to the grooves at about the 260 to 270 degree position of the turret. (As shown in FIG. 4, vertical is zero degrees.) During the entry of belts 84 into grooves 80, the relative motion of inner annular surfaces 98 of belts 80 and inner annular walls 86 of grooves 80 is an axial closing action with surfaces 98 moving axially toward inner annular walls 86.

Belts 84 commence to exit grooves 80 slightly after the tangency of turret 54 with horizontally disposed lower web 42 or about 270 to 280 degrees from the entrance of the belts into contact with groove surfaces 86 and 88. During exit of the belts 84 from grooves 80, the relative motion of inner annular surfaces 98 of belts 84 and inner annular walls 86 of grooves 80 is a separating action with surfaces 98 moving axially away from inner annular walls 86.

The foregoing action of belts 84 relative to grooves 80 on cylindrical surface 70 of turret 54 is utilized to retain upper web 42 upon the surface of forming dies 72. The movement of the belts relative to the grooves 80 is depicted in FIGS. 5 through 12. Also illustrated is the manner in which the upper web 42 is retained upon turret die sets 72 during the arc of rotation of the turret in which the belts 84 are disposed in grooves 80. Only one groove and belt are illustrated. However, the disposition and movement of the second belt relative to the second groove is the mirror image of the components shown.

Figure 6:
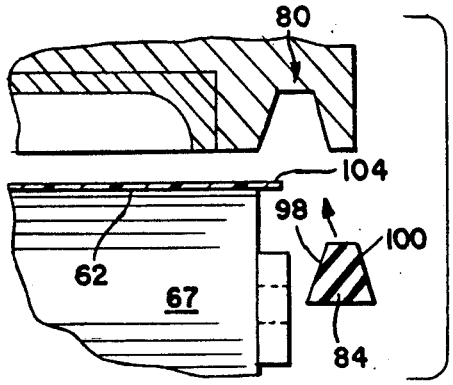

In FIG. 5 the belt 84 is shown passing about groove 90 in pulley 82. Inner annular surface 98 is in contact with inner annular wall 92 of pulley 82. FIG. 6 shows the belt at a location intermediate pulley 82 and turret groove 80 and moving toward the groove. Also shown is the position of web guide roll 67 and upper web 62 moving in a generally vertical path toward tangent contact with outer surface of turret 54.

Figure 7:
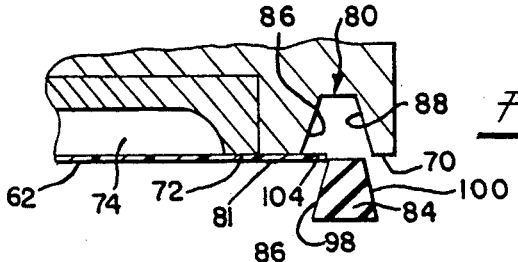

FIG. 7 shows web 62 in contact with turret 54 in overlying relation to forming dies 72. The width of the web exceeds the axial distance between the grooves 80 on the turret. For that reason, an edge portion 104 of web 62 overlies each groove 80. The edge portion 104 is of a width which does not exceed the radial length of inner annular wall 86 of groove 80. Belt 84 is shown nearing disposition within groove 80.

Figure 8:
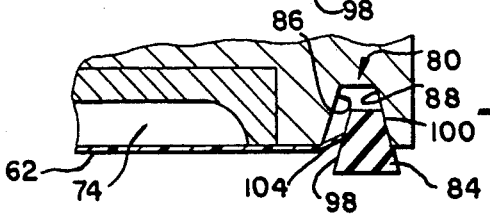

FIG. 8 shows belt 84 entering groove 80. Here the action of the inner annular surface 98 of belt 84 relative to inner annular wall 86 of groove 80 is an axial closing action. Outer annular surface 100 of belt 84 is in contact with outer annular wall 94 of groove 80. Web 62 is in full contact with the outer cylindrical surface 70 of drum 54. Edge portion 104 of the web is caused to fold into groove 80.

Figure 9:
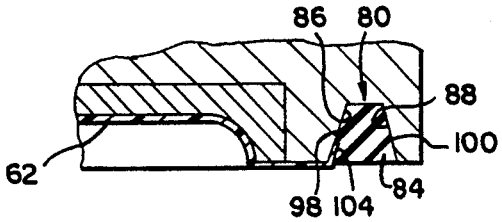

In FIG. 9, the belt 84 has completely entered groove 80. The outer annular surface 100 of the belt 84 is in contact with outer annular wall 88 of groove 80 and inner annular surface 98 of belt 84 is in contact with inner annular wall 86 of groove 80. Web edge portion 104 has been forced into groove 80 by the movement of the belt 84 into the groove. Web edge portion 104 is pinched between inner annular wall 86 of groove 80 and inner annular surface 98 of belt 84. The web 62 has been formed with depression 74 by forming die 72.

The movement of the belts 84 into the grooves 80, which results in an axial closing action on opposite edges of the web, has the effect of stretching web 62 axially of the turret 54. This axial pulling of web 62 between grooves 80 results in a taut disposition of web 62 upon the forming dies 72 for processing.

Figure 10:
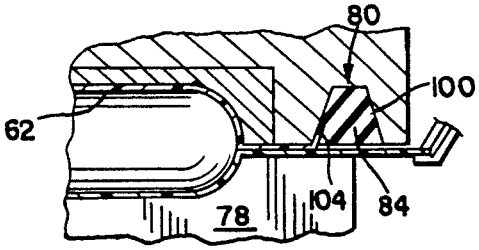

FIG. 10 is a cross-section taken slightly beyond the point of tangency of turret 54 with lower web 42. The lower web is shown retained in clamp 34 with its depression filled with product 50. Upper web 62 has been deposited onto lower web 42 and depression 74 is positioned to overlie the product. Tacking or heating bar 78 is shown which heat seals upper and lower webs 62 and 42 together along a line extending transversely of web movement.

Figure 11:
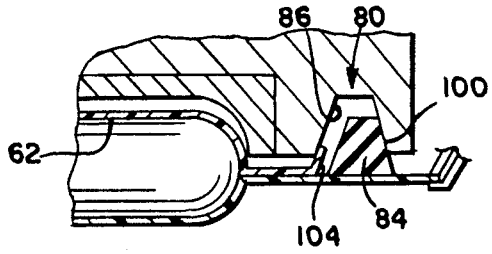

FIG. 11 illustrates the belt 84 exiting the groove as it returns to pulley 82. Outer annular surface 100 remains in contact with outer annular wall 88 of groove 80. Inner annular surface 98 has moved away from inner annular wall 86 in an opening action and web edge portion 104 is released from gripping contact. The two webs proceed together along processing zone 27.

Figure 12:
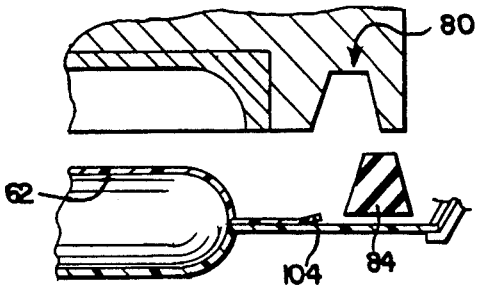

FIG. 12 shows belt 84 after it has completely exited groove 80 and has nearly returned to groove 90 of pulley 82. The two webs, with product encased in the formed depressions in the upper and lower webs, continue to be advanced through zone 27 by clamps 34 and chains 32.

It should be noted that the outer surface of a drum utilizing the retention and advancement mechanism of the present invention need not be cylindrical. It could be any suitable cross section such as oval, or even square, or rectangular with curved transitional zones between walls. The important feature of the mechanism is that the endless belts 84 act against the groove walls for a period of drum rotation to clamp and retain an overlying web to the drum.

Figure 13:
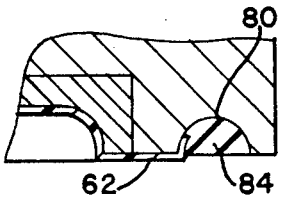
FIG. 13 is a fragmentary sectional view similar to FIG. 9 showing a modified form of the invention.

Further, FIG. 13 illustrates that the cross section of the grooves 80 and belts 84 need not be trapezoidal. Groove 80 is shown as having a semi-circular cross section and belt 84 is provided with a mating running surface. A round belt could also be used.

Various features of the invention have been particularly shown and described in connection with the illustrated embodiment of the invention, however, it must be understood that these particular arrangements merely illustrate and that the invention is to be given its fullest interpretation within the terms of the appended claims.

We claim:

1. A web retention and advancement mechanism for retaining a web upon a rotatable drum during an arcuate portion of its rotation; said drum being adapted to receive a web upon its outer surface; said mechanism comprising:

two spaced grooves formed on said drum, each groove having an inner groove defining wall, said drum inner groove defining walls being spaced apart from each other a distance which is less than the axial width of the web; a pulley associated with each said groove and spaced from said drum in general alignment with its associated drum groove, each said pulley defining a groove including an inner groove defining wall, said pulley inner groove defining walls spaced apart a distance greater than the distance between said inner groove defining walls of said drum;

a pair of endless belts each one of which is positioned in a groove of said drum and a groove of one of said pulleys, each said belt being tensioned between said drum and pulley and being rotatable with said drum, each said belt having an inner annular surface in contact with a portion of said inner wall of one of said grooves in said drum to retain edges of the web in said grooves in said drum.

2. A web retention and advancement mechanism as claimed in claim 1 wherein said grooves are trapezoidal in cross-section.

3. A web retention and advancement mechanism as claimed in claim 2 wherein said belt is trapezoidal in cross-section.

4. A web retention and advancement mechanism as claimed in claim 1 wherein said drum is cylindrical and the axis of rotation of said pulleys are parallel to the axis of rotation of said drum.

5. A web retention and advancement mechanism as claimed in claim 4 wherein said grooves are trapezoidal in cross-section.

6. A web retention and advancement mechanism as claimed in claim 5 wherein said belts are trapezoidal in cross-section.

7. A web retention and advancement mechanism as claimed in claim 1 wherein the axes of rotation of said pulleys are canted such that said pulley grooves converge in a direction toward said drum.

8. A web retention and advancement mechanism as claimed in claim 1 including means to bias said pulleys away from said drum to tension said belts between said pulleys and said drum.

9. A web retention and advancement mechanism as claimed in claim 1 wherein said drums include outer groove defining walls, and the inner groove defining walls of said pulleys are disposed an axial distance apart which is less than the distance between said outer groove defining walls of said grooves in said drum.

10. A web retention and advancement mechanism as claimed in claim 1 wherein said belts ar sized and said pulleys are spaced from said drum a distance such that said belts are disposed in said grooves on said drum for an arcuate distance of about 270 to 280 degrees of said drum periphery.

11. A method of retaining and advancing a web upon a rotating drum, the steps comprising:

providing a pair of spaced grooves about the outer periphery of said drum;

said grooves having inner groove defining walls with inner edges spaced apart a distance which is less than the width of the web;

providing a pair of pulleys, each pulley defining a groove having an inner groove defining wall and spacing said pulley inner groove defining walls apart a distance greater than the distance between said drum inner groove defining walls;

providing an endless belt including inner surfaces for each said groove and causing said belts to transcribe a path convergent from said pulley grooves to said drum grooves moving said inner surfaces of said belts toward said inner groove defining walls of said grooves as said belts enter said grooves and causing said belt to travel in said groove for an arcuate portion of each rotation of said drum;

causing edges of said web to overlie said grooves as said belts enter said grooves;

gripping said edges between said inner surfaces of said belts and said drum inner groove defining walls during the arcuate portions of rotation of said drum that said belts are disposed in said grooves.

12. A method as claimed in claim 11 wherein said method further comprises causing said inner annular surfaces of said belts to move away from said inner groove defining walls of said grooves as said belts exit said grooves to release the edges of said web.

13. A method as claimed in claim 11 further comprising causing said belts to be disposed in said grooves an arcuate distance of between about 270 to 280 degrees of said drum rotation.

* * * * *